United States Patent [19]

Brisebarre

[11] 4,361,162

[45] Nov. 30, 1982

[54] SEQUENTIAL COIN DISPENSER

[75] Inventor: Marcel M. Brisebarre, Thoiry, France

[73] Assignee: ATS Advanced Technics & Systems, S.A., Lausanne, Switzerland

[21] Appl. No.: 180,959

[22] Filed: Aug. 25, 1980

[30] Foreign Application Priority Data

Sep. 3, 1979 [CH] Switzerland ..... 7963/79

[51] Int. Cl.[3] ..... G07D 1/00

[52] U.S. Cl. ..... 133/4 A; 133/2; 133/8 E

[58] Field of Search ..... 133/2, 4 A, 4 R, 5 R, 133/8 E, 3 F, 1 R; 221/94, 95, 123, 129, 215, 217, 218

[56] References Cited

U.S. PATENT DOCUMENTS

| | | | |
|---|---|---|---|
| 4,080,973 | 3/1978 | Kobayashi | 133/5 R |
| 4,126,147 | 11/1978 | Brisebarre et al. | 133/2 |
| 4,276,894 | 7/1981 | Heywood et al. | 133/5 R |

*Primary Examiner*—H. Grant Skaggs

*Attorney, Agent, or Firm*—Eugene E. Geoffrey, Jr.

[57] ABSTRACT

A coin dispenser having a plurality of columns holding coins of different denominations in linear alignment one with the others, a plurality of extraction fingers each moving successively beneath the stacks and a cam arranged for movement in alignment with and beneath the fingers with movement of the cam being effected by engagement with one of the fingers when coins are not to be extracted and is displaced relative to the fingers beneath a selected column when a coin to be extracted therefrom to permit a cam follower carried by a finger to engage and be displaced by the cam and thereby dislodge a coin carried by the selected column.

10 Claims, 12 Drawing Figures

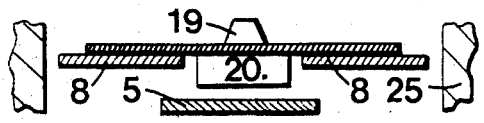
FIG.5
FIG.4
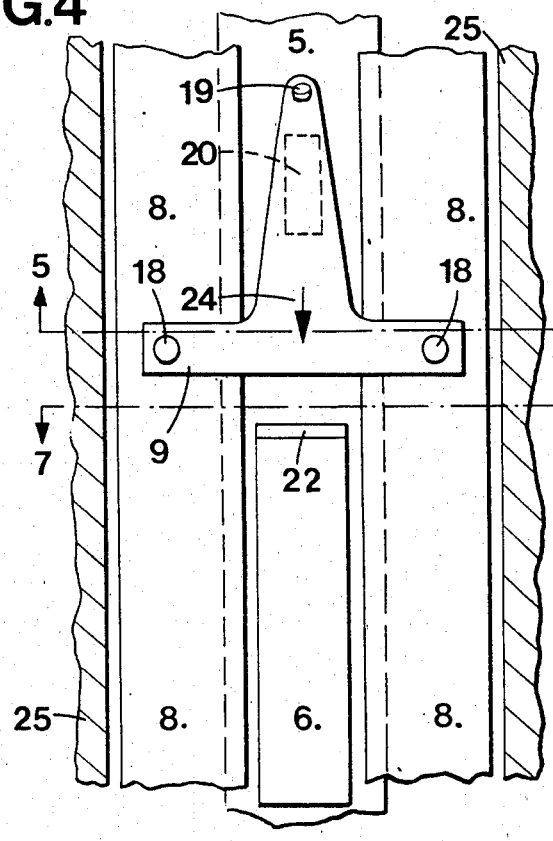
FIG.6
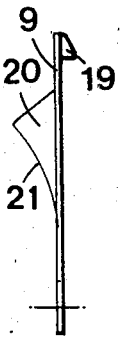
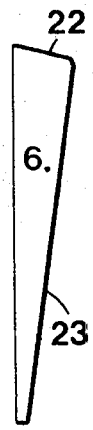
FIG.8
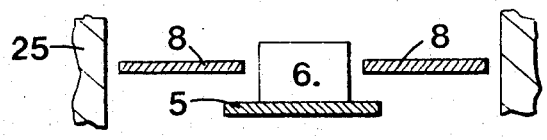
FIG.7

SEQUENTIAL COIN DISPENSER

U.S. Pat. No. 4,126,147 discloses a machine for dispensing coins in a sequential manner. It includes a stacking device comprising a stack for each coin denomination, these stacks being arranged in parallel with each other, a numeral value insertion device, a logic computing unit determining by sucessive substractions, starting by the highest value denomination, the number of times that a coin of each denomination is required to achieve a sum to be returned, a mechanism for extracting the coins one after the other, step controlled by the logic computing unit and a control member of the effective output of each coin required successively, reacting on the computing unit to automatically call for lower denomination coins in case a required coil has not been delivered. The extraction mechanism is comprised of two concentric cylinders. The outer cylinder comprises extraction fingers, one finger per coin stack, arranged in spiral around the cylinder, the latter being continuously driven in rotation by an electric motor. The inner cylinder comprises a series of cams, one cam per ejection device, arranged according to a line parallel to the cylinder axis. A system of pawls allows the outer extraction cylinder and the inner cam cylinder to co-operate so as to eject one coin of a predetermined stack at each rotation. Since only one coin is allowed to be ejected at each rotation, the outer cylinder must rotate at a high speed so as to provide a good performing machine.

The major drawback in such a machine is that, the outer cylinder rotating constantly at high speed, each extraction finger ejects the coin with violence, which, with the shock effect, may result in jamming and consequently damaging of the machine. Furthermore, a succession of such shocks are noisy, which makes the use of the machine troublesome.

Another inconvenience is that the coins, after the shock, are brought to the dispenser under the effect of their inertia and their gravity.

Another short-coming is that the construction of such a machine, more particularly its extraction mechanism, is complicated and subsequently, relatively delicate to control. Further, one had to act selectively and promptly on the poles rotating permanently to position relatively between each other both rotating concentric cylinders, which implied very strict delay tolerances on the controls.

The object of the present invention is to provide a dispenser machine for dispensing sequentially coins, of a simpler construction and consequently easier to control, of which the extraction mechanism is highly improved: it comprises only one cam for a series of extraction fingers passing successively under each stack, allowing to eject a series of coins in an optimum manner as it will be described hereafter, the control circuit not being bound by the construction imposing the ejection of a single coin per rotation; it forms at the same time a coin extraction and transport mechanism; it is also noiseless when in use, since the extraction mechanism rotates at a lower speed.

The object of the invention, therefore, is a novel and improved sequential coin dispenser.

The invention will be better understood by means of the following figures given as examples and presenting certain forms of execution of the invention.

FIG. 4 shows the arrangement of the belts, of an extraction finger and the cam of the extraction mechanism of the dispenser.

FIG. 5 is a cross-section view according to the line 5—5 of FIG. 4.

FIG. 6 is a side view of the extraction finger.

FIG. 7 is a cross-section view according to the line 7—7 of FIG. 4.

FIG. 8 is a side view of the cam.

Figure 1:
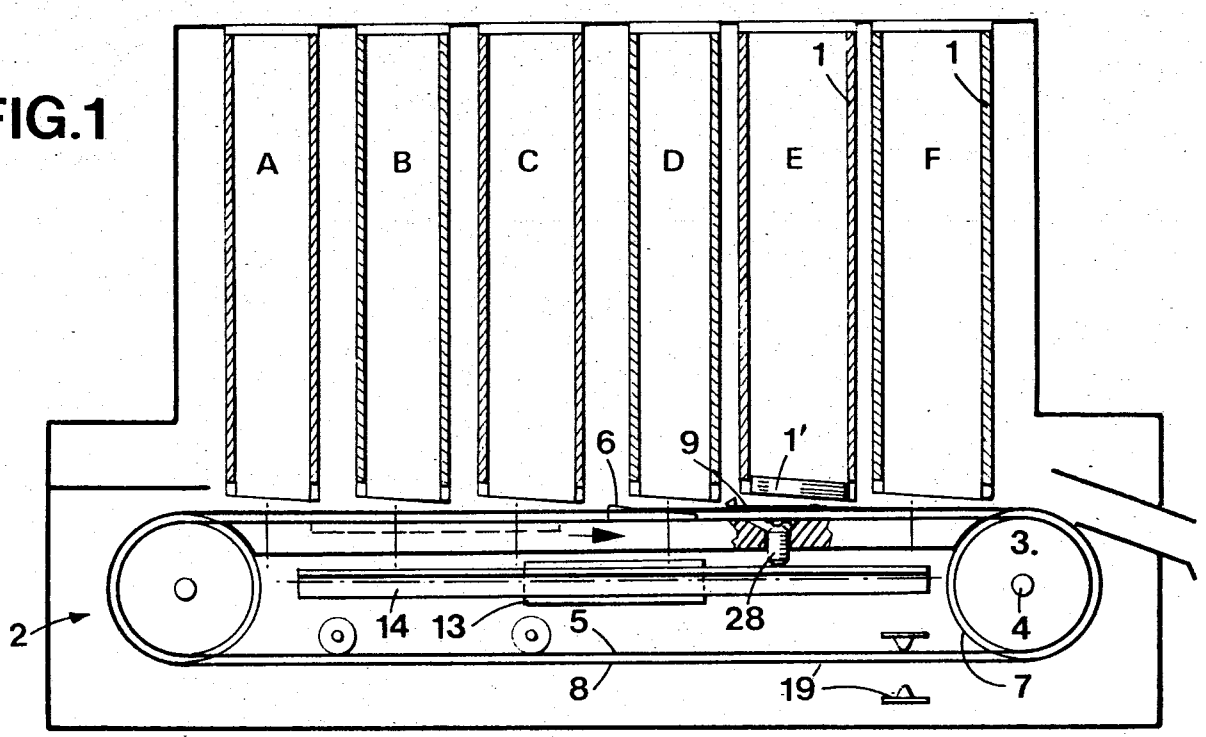
FIG. 1 shows a diagrammatic front view of a form of execution of the dispenser.
Figure 2:
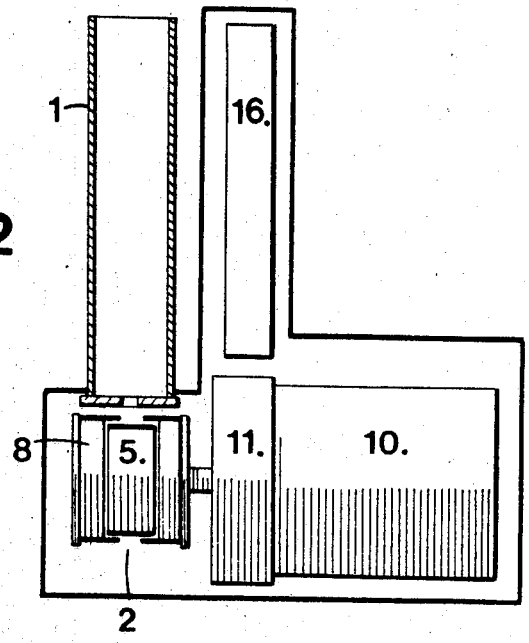
FIG. 2 shows a diagrammatic side view of the dispenser.
Figure 3:
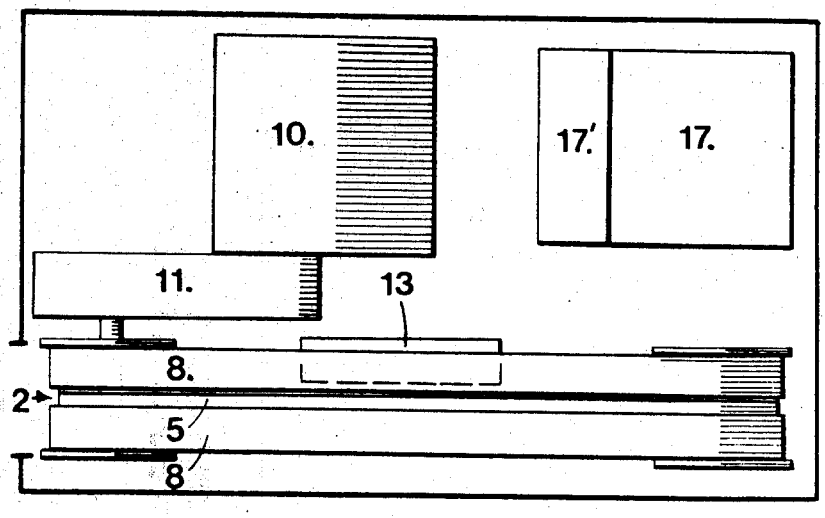
FIG. 3 shows a diagrammatic view of the bottom of the dispenser.

FIGS. 1, 2 and 3 depict diagrammatically and as a whole, the dispenser, object of the invention. It is composed of a series of columns 1 of different diameters corresponding to different denomination coins, each column containing coins 1' of a certain denomination. An extraction mechanism 2 is arranged under the columns 1. Two pulleys 3 are arranged at the end of the extraction mechanism 2 by means of shafts 4. An endless belt 5 is carried by said pulleys 3 and may move freely. A single cam 6 is fixed on to the belt 5 and may also move freely. Each shaft 4 also carries on each side of the pulley 3 two other pulleys 7 carrying parallel endless belts 8. These two belts form a single rotating device on which is arranged a series of similar extraction fingers 9 which follow each other at regular intervals. A motor 10 followed by a reductor 11 drives continuously the rotating device. The cam 6 and the extraction fingers 9 co-operate so that in the non-extraction mode, the belt 5 is driven by the rotating device 8. An actuator device composed of an electro-magnet 13 and a corner 14 controls a series of pistons 28 arranged exactly on the axis of each column of coins, thus actuating the cam 6 for the extraction of the desired coins. The arrangement and operation will be described in details hereafter. The electro-magnet and, subsequently, the actuator device are controlled by a control circuit 16 supplied by a transformer 17 followed by a rectifier and filtering stages 17'. A photo-detector 19' detects the positioning of the cam 6 on the belt 5 and counts the number of extractor fingers 9 of the rotating device 8. It provides this information to the control circuit 16. The control circuit 16 according to the information it receives such as sum to be returned or positioning of the cam, gives sequential orders to the actuator for a sequential extraction of coins. The control circuit 16 may be comprised of wired logic circuits or may be achieved on the basis of a micro-processor.

FIGS. 4 to 8 depict in a detailed manner the arrangement on the different belts and the shape respectively of the cam 6 and of an extractor finger 9.

An extractor finger 9 is T-shaped and is fixed to the belts 8 by means of two rivets 18. The belts 8 comprise a succession of such extractor fingers 9 on their endless periphery. These belts 8 are interdependent or integral by the fixing thereon of the extractor fingers 9 which hold them together. An extractor finger 9 comprises at one end and on one of its faces a pin 19 intended to come into abutment with the coins to be extracted. On its other face, the ejector finger 9 comprises a substantially triangular cross-sectioned cam follower 20 comprising particularly a side 21 slightly curved inwardly. The inner belt 5 carries the triangular sectioned cam 6 having a side 23 slightly inclined with respect to the horizontal line and a side strongly inclined, practically vertical, with respect to the horizontal line. FIG. 4 depicts how the cam follower 20 goes through the opening left free between the two belts 8 and FIG. 8 depicts how the cam 6 traverses this opening. It should be remembered that the belts 8 carrying the ejector fingers are continuously driven by a motor in the direction of the arrow 24 between holding slides 25.

Figure 9:
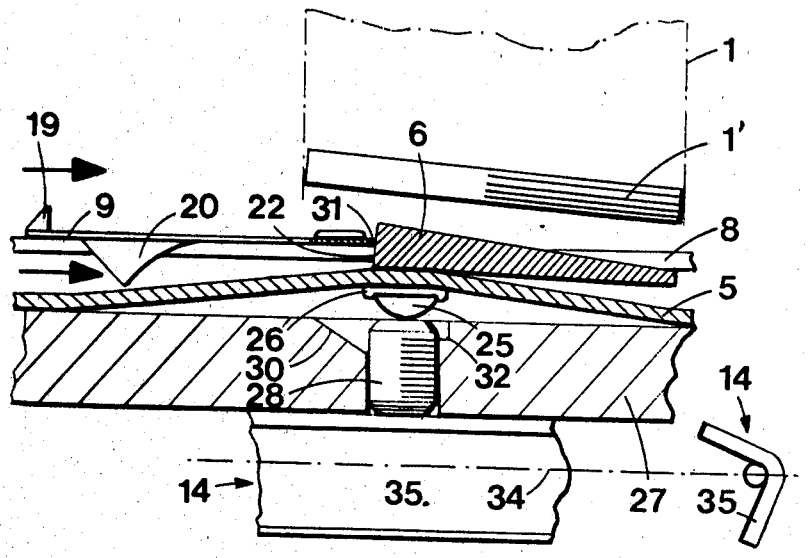
FIG. 9 shows a cross-section and side view of the cam and the extraction finger in motion, the piston not being retracted.
Figure 10:
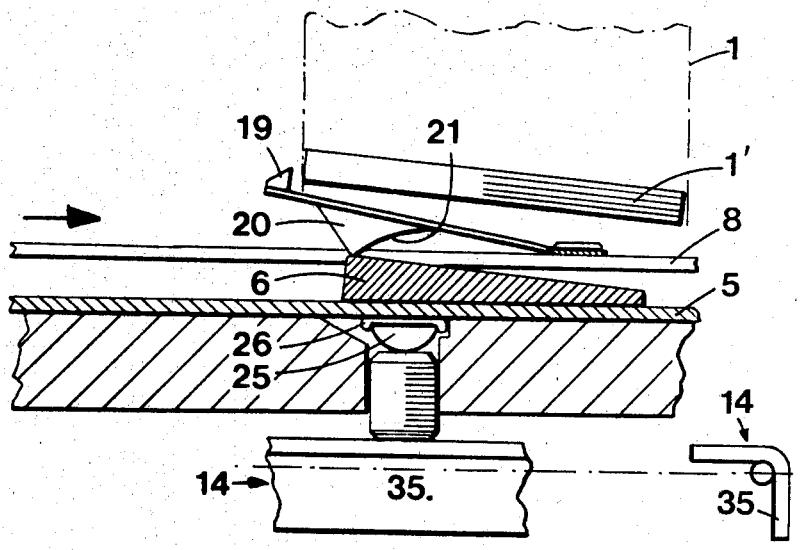
FIG. 10 shows a cross-section and side view of the cam in a fixed position, the piston being retracted ready for extraction.

FIGS. 9 and 10 show how the belts 8 and 5, the cam 6 and one of the extractor fingers 9 co-operate to eject a coin 1' from a column 1. The belt 5 comprises, besides the single cam 6, a stud 25 provided under the belt 5 and facing the cam 6. It may be formed by a round head screw which, when going through the belt 5, secures also the cam 6 onto the belt 5. The belt 5, as it has already been explained, may move freely, the pulleys 3 (FIG. 1) being free on their shafts 4 (FIG. 1). A washer 26, acting as a stop, is inserted between the stud 25 and the belt 5. A slide or guide strip 27 is arranged under the belt 5 and comprises an opening wherein a piston 28 operates actuated either in an advanced position (FIG. 9), or in a retracted position (FIG. 10). This position change of the piston is effected by means of an actuator device controlled by the electro-magnet 13 (FIG. 3) and will be described hereafter in more details. As explained in FIG. 1, the guide strip 27 comprises a series of openings having each a piston 28 arranged under each column 1 of coins. All these pistons 28 are actuated simultaneously in an advanced or retracted position.

FIG. 9 shows the extraction mechanism in the advanced position. The piston 28 is actuated upwardly and blocks the opening in the guide strip 27. The belts 8 permanently actuated drive the belt 5 with an elastic deformation, the extractor finger 9 coming into abutment by its lower part 31 against the substantially vertical portion 22 of the cam 6 which accommodates between the belts 8. Thus, the belts 8 and 5 move together and not a single coin is ejected. It should be noted that the inclined portion 30 of the opening in the guide strip is insufficient to allow the stud 25 and its stop 26 to wedge into said opening.

Reference is now made to FIG. 10 to see how a coin is extracted. To this effect, the piston 28 is moved downwards, setting free or unblocking the corresponding opening in the guide strip 27. The stud 25, pressed downwardly by the elasticity of the belt 5, co-operates to the displacement of the piston, which is not actuated any more, by chasing it downwardly. Then, the stud 25 accommodates into this opening by sliding onto its portion 30 and finally abuting by its washer 26 into its portion 32. During this operation, cam 6 is lowered and freed from the extractor finger 9 which continues to move in the direction of the arrow indicated, still actuated by the motor. The cam 6 being fixed, the extractor finger 9 will come into contact with the cam by the curved portion 21 of the cam follower 20 thereof. The extractor finger 9 is thus raised and the pin 19 will come into contact with the last coin 1' of the column 1. This coin 1' will be extracted and driven towards the exit or output by the belts 8 on which it now rests. As long as the cam 6 is fixed, each extraction finger passing on top of it will take a coin 1' from the column 1. As soon as no more coins 1' are required, the piston 28 will be actuated again upwardly, and this between two passages of extractor fingers 9, and the next extractor finger will drive again the cam 6, as described in FIG. 9, to the next column of the desired coin.

Figure 11:
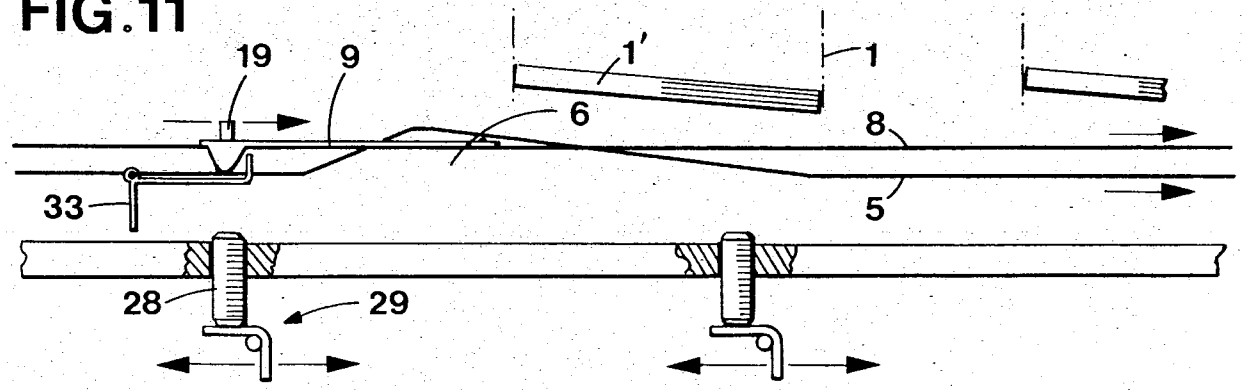
FIG. 11 shows another form of execution of the arrangement of the belts, of the cam and the extraction finger, the pistons not being actuated.
Figure 12:
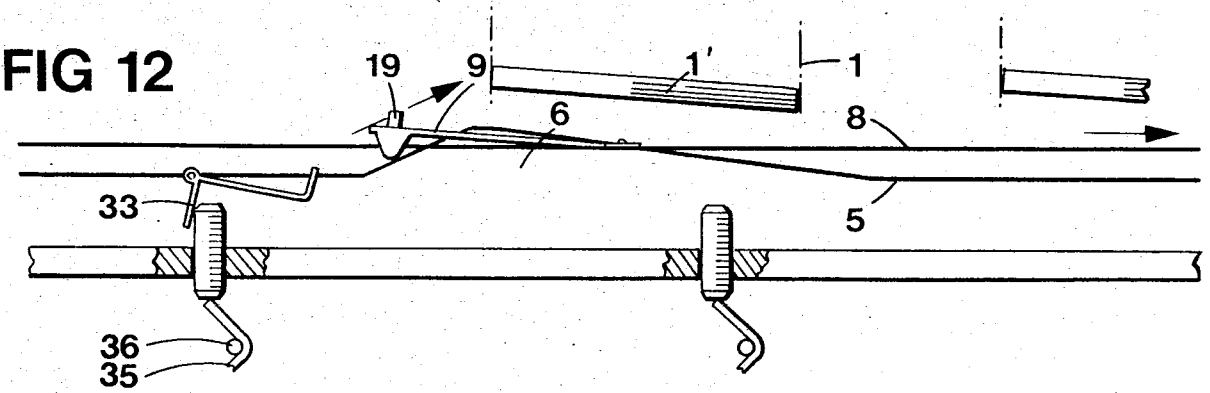
FIG. 12 shows the form of execution of FIG. 11, the cam and its belt being fixed, the pistons being actuated for an extraction.

FIGS. 11 and 12 describe diagrammatically another form of execution based on the same principle for the ejection of coins. In FIG. 10, the belts 8 and the head of the extractor finger 9 drive the belt 5 and its cam 6 by means of a pawl 33 provided on the belt 5. When it is desired to latch the cam 6 and a column of coins 1, see FIG. 11, the electro-magnet is actuated and it controls the actuator device. Thereafter, the piston 28 goes up, rocks the pawl 33, latches the belt 5 and its cam 6, and allows the extractor finger 9 to raise and, by means of its pin 19, to extract a coin and transport the coin onto the belts 8 to the exit.

The actuator device may be formed of a corner 14 having an L section, pivoting about an axis 34, extending under the pistons 28 for actuating all of them simultaneously. This corner 14 is actuated at right angles at its surface 35 by the electro-magnet 13. This is shown diagrammatically in FIGS. 1, 9 and 10. FIGS. 11 and 12 show another form of execution. As a fact, under each piston, there is provided an L-shaped part 35 pivoting about an axis 36. This linking system, not represented, connects the pistons together so that they may all be actuated simultaneously by an electro-magnet.

We now come back to the description as a whole and show how a certain amount of money may be dispensed by means of the described extraction mechanism. We will refer to FIG. 1. The spacings between columns 1 are variable, as a function of the diameter of the different coins. The spacing between the general purposes extraction fingers is proportional to the number of the selected fingers, but this spacing is always equal. The cam belt 5 carries photo-electrically readable markings, one single marking per column, allocated according to the spacing selected for the columns. The markings are photo-electrically read by the detector 19'. These markings are not necessary for the positioning itself of the cam 6, but are only necessary for the control circuit 16 to know under which column is cam 6. It should be remembered that the positioning of cam 6 is done automatically by the operation of the pistons 28 arranged under each column 1. The counting of the extracted coins is effected by means of an output detector actuated by specific sensors located at the output of each column. Such a sensor may be an elastic clip which retains the last coin of the column. It should also be noted that the extraction in the direction of alignment of the columns requires that the coins to be extracted are slightly slant so as not to abut against next column. Further, the apparatus is stopped when not working, the extraction mechanism being operated in rotation only at the start of the transaction.

Supposing now that three coins of column B and two coins of column D must be returned, this combination corresponding to a predetermined sum to be returned. The control circuit 16 gives the order to the extraction mechanism 2 to set in operation, the electro-magnet 13 being actuated to position the pistons 28 upwardly by means of the corner 14. The detector 2 indicates to the control circuit 16 where the cam 6 is located, in relation to the markings provided on the belt 5. According to this information, the control circuit 16 knows what is the time to wait before freezing the electro-magnet 13. Once the time has come, therefore at the time when the cam 6 comes under the column B, the electro-magnet is de-energised and the cam 6 is fixed while the extractor fingers 9 move past taking away coins from column B. After the output sensor has indicated to the control circuit that three coins have been extracted, the control circuit actuates or energises the electro-magnet 13 and the cam 6 is raised and driven again by the next extraction finger 9 until it gets under the column D where the ejection operation is again effected, but only for two coins.

If column B contains only two coins, the absence of such a coin will be indicated to the control circuit by means of the sensor associated to the output detector. The control circuit will correct the extraction sequence of the coins as a function of the coins available, while providing a signal indicating that such column is empty.

Such a working program is readily feasible and particularly when operating with a micro-processor. For example, the micro-processor TMS 1000 of Texas Instruments may be used.

I claim:

1. Sequential coin dispenser comprising coin stacks, at least one per coin denomination, a rotating extraction mechanism comprising extraction fingers and a cam acting on these extraction fingers, an actuating device operable to displace said cam to effect extraction and a control circuit (16) interconnected with said actuating device for operation thereof, characterized in that in the extraction mechanism (2) the extraction fingers (9) are carried by first rotating means (8) so that each extraction finger (9) is moved successively under each stack (1) of coins, in that the cam (6) is carried by seconds means (5) driven by the first rotating means (8) and in that positioning means (25, 26, 27, 28) co-operate with the actuating device (13, 14, 8) so that when such device is actuated, the second means (5) and the cam (6) thereof are freed from the first rotating means (8) which drive them and they come into a predetermined position, allowing the extraction fingers (9) still in motion to effect the extractions.

2. Dispenser according to claim 1, characterized in that the first rotating means are comprised of at least an endless transmission member (8) circulating about two pulleys (7) carried by shafts (4) so as to form a horizontal section located under the alignment of the stacks (1), the transmission member (8) being permanently driven during an extraction operation by an electric motor acting on these pulleys (7).

3. Dispenser according to claim 2, characterized in that the second means are comprised of an endless transmission member (5) arranged in parallel to the transmission member (8) of the first rotating means about two other pulleys (3).

4. Dispenser according to claim 3, characterized in that the positioning means are comprised, on one hand, of a fixed slide (27) on which the transmission member (5) of the second means slides, said slide (27) comprising openings arranged facing the stacks (1) wherein pistons (28) slide, said pistons being controlled simultaneously by the actuating device so as to close or uncover the openings of the slide (27) and, on the other hand, a stud (25) arranged on the transmission member (5) of the second means, at the location where the cam (6) is provided, said stud (25) being capable of wedging into an opening when the corresponding piston (28) is retracted, thus allowing the transmission member (5) and its cam (6) to block under a selected stack (1) of coins, the cam (6) thus secured co-operating then for extractions with the extraction fingers (9) always in motion.

5. Dispenser according to claim 4, characterized in that the stacks are arranged in alignment, spaced between each other according to an irregular configuration.

6. Dispenser according to any of claims 1 to 5, characterized in that each extraction finger comprises a pin (19) provided on one of the faces thereof for extraction of coins and a cam follower (20) on the other of the faces thereof, the end of said finger being in contact with the cam (6) in one position so as to drive the cam and said cam follower (20) being brought in contact with the cam (6) only when the cam is in another position to raise the pin (19) and effect an extraction.

7. Dispenser according to any of claims 1 to 5, characterized in that the extraction fingers (9) are secured onto the transmission member (8) of the first rotating means in a regularly spaced relationship.

8. Dispenser according to any of claims 1 to 5, characterized in that the transmission member (5) of the second means comprises markings which can be read by a detector (19') so as to indicate to the control circuit (16) of the actuating device (13, 14) the position of cam (6).

9. Dispenser according to any of claims 1 to 5, characterized in that it comprises means allowing to indicate to the control circuit the number of coins extracted from the stacks.

10. Dispenser according to any of claims 1 to 5, characterized in that the actuating device includes an electro-magnet (13) controlled by the control circuit (16) acting on a longitudinal part (14) so as to simultaneously act on all the pistons (28).

* * * * *